US007594860B2

(12) United States Patent
Good et al.

(10) Patent No.: US 7,594,860 B2
(45) Date of Patent: Sep. 29, 2009

(54) GOLF SWING TRAINING METHOD AND APPARATUS

(75) Inventors: Andrew Jason Good, Happy Valley (HK); Ha Nam Roger Wong, North Point (HK)

(73) Assignee: Dream N Act Co. Limited, Hong Kong (HK)

( * ) Notice: Subject to any disclaimer, the term of this patent is extended or adjusted under 35 U.S.C. 154(b) by 131 days.

(21) Appl. No.: 11/581,552

(22) Filed: Oct. 16, 2006

(65) Prior Publication Data

US 2008/0090673 A1 Apr. 17, 2008

(51) Int. Cl.
*A63B 69/36* (2006.01)

(52) U.S. Cl. ..... 473/261; 473/151; 473/221; 473/257

(58) Field of Classification Search ..... 473/198, 473/199, 150, 151, 155, 156, 221, 222, 224, 473/225, 234, 219, 257
See application file for complete search history.

(56) References Cited

U.S. PATENT DOCUMENTS

| | | | | | |
|---|---|---|---|---|---|
| 3,009,704 | A * | 11/1961 | Heard | 473/151 |
| 3,801,108 | A * | 4/1974 | Murray | 473/225 |
| 4,577,868 | A | 3/1986 | Kiyonaga | |
| 4,615,526 | A | 10/1986 | Yasuda et al. | 273/183 |
| 4,903,968 | A * | 2/1990 | Hargrave | 473/220 |
| 5,114,150 | A | 5/1992 | Matsumura | 273/186 |
| 5,472,205 | A | 12/1995 | Bouton | 273/187.1 |
| 5,511,789 | A | 4/1996 | Nakamura | |
| 5,718,639 | A * | 2/1998 | Bouton | 473/151 |
| 5,826,874 | A | 10/1998 | Teitell | 473/225 |
| 5,919,099 | A | 7/1999 | Woods | |
| 6,089,989 | A * | 7/2000 | Sutcliffe | 473/225 |
| 6,821,211 | B2 * | 11/2004 | Otten et al. | 473/219 |
| 2005/0159231 | A1 | 7/2005 | Gobush | |

FOREIGN PATENT DOCUMENTS

WO WO 2006078203 A 7/2006

* cited by examiner

*Primary Examiner*—Nini Legesse
(74) *Attorney, Agent, or Firm*—Renner, Kenner, Greive, Bobak, Taylor & Weber

(57) ABSTRACT

A golf swing training apparatus for practicing a golf swing. In one embodiment, the training apparatus includes a sensor unit including a sensor outputting a sensor beam in a substantially horizontal direction, the sensor unit further including a microcontroller in operable communication with the sensor, the microcontroller configured to detect a break in the sensor beam, the sensor unit further including one or more visual indicators, wherein the one or more visual indicators are in operable communication with the microcontroller, and wherein the one or more visual indicators are activated in response to the break in the sensor beam; and a frame coupled to the sensor unit, the frame including a reflector configured to reflect the sensor beam. In another embodiment, a section of the frame may be moved between a first position used to practice driving and a second position used to practice pitching and chipping.

9 Claims, 16 Drawing Sheets

GOLF SWING TRAINING METHOD AND APPARATUS

FIELD OF THE INVENTION

The present invention relates generally to golf, and more specifically, a method and apparatus to assist a user in practicing a golf swing.

BACKGROUND OF THE INVENTION

The difficulty inherent in the game of golf has caused many golfers to seek ways to improve their ability at the game of golf. Golf swing and putting practicing devices are presently known. However, many of these devices are large, cumbersome, unable to be transported easily, and ineffective at teaching the skills that are required to improve a golf swing.

Accordingly, there remains a need for a golf swing training device that addresses the present limitations and shortcomings of these existing devices.

SUMMARY OF THE INVENTION

According to one embodiment of the invention, a golf swing training apparatus is disclosed. The golf swing training apparatus includes a sensor unit including a sensor outputting a sensor beam in a substantially horizontal direction, the sensor unit further including a microcontroller in operable communication with the sensor, the microcontroller configured to detect a break in the sensor beam, the sensor unit further including one or more visual indicators, wherein the one or more visual indicators are in operable communication with the microcontroller, and wherein the one or more visual indicators are activated in response to the break in the sensor beam; and a frame coupled to the sensor unit, the frame including a reflector configured to reflect the sensor beam.

According to another embodiment of the invention, a golf swing training apparatus is disclosed. The golf swing training apparatus includes a sensor unit including a sensor outputting a sensor beam in a substantially horizontal direction, the sensor unit further including a microcontroller in operable communication with the sensor, the microcontroller configured to detect a break in the sensor beam, the sensor unit further including one or more visual indicators, wherein the one or more visual indicators are in operable communication with the microcontroller, and wherein the one or more visual indicators are activated in response to the break in the sensor beam; and a frame coupled to the sensor unit, the frame including a first section and a second section, wherein the first section is selectively movable relative to the second section between a first position and a second position, the second section of the frame including a reflector configured to reflect the sensor beam.

According to yet another embodiment of the invention, a golf swing training apparatus is disclosed. The golf swing training apparatus includes a sensor unit including a sensor outputting a sensor beam in a substantially horizontal direction, wherein the height of the sensor in the sensor unit is selectively adjustable between approximately 6 millimeters and 20 approximately millimeters above a base of the sensor unit, and the sensor beam is output in a direction selectively adjustable between a first position and a second position, the sensor unit further including a microcontroller in operable communication with the sensor, the microcontroller configured to detect a break in the sensor beam, the break in the sensor beam generated in response to a golf club head passing through the sensor beam, the sensor unit further including one or more light emitting diodes and an audible alarm, wherein the one or more light emitting diodes and the audible alarm are in operable communication with the microcontroller, and wherein the one or more light emitting diodes and the audible alarm are activated in response to the break in the sensor beam; and a frame coupled to the sensor unit, the frame including a reflector configured to reflect the sensor beam and a reflector guard proximate to the reflector, the frame further having an arcuate shape outlining a golf swing path and a direction edge configured to indicate a ball travel direction.

BRIEF DESCRIPTION OF THE DRAWINGS

These and other features, aspects, and advantages of the present invention will become better understood with regard to the following description and accompanying drawings where.

DETAILED DESCRIPTION

The detailed description sets forth below in connection with the appended drawings is intended as a description of example embodiments of the present invention and it is not intended to represent the only embodiments in which the present invention can be practiced. The embodiments described throughout this description are intended to serve as examples or illustrations of the present invention and should not necessarily be construed as preferred or advantageous over other embodiments. Any number of the described embodiments and variations may be incorporated in any desired combination. The detailed description includes specific details for the purpose of providing a thorough understanding of the present invention. However, it will be apparent to those skilled in the art that the present invention may be practiced without certain specific details.

In the following description, reference is made to the accompanying drawings, in which specific embodiments of the invention are shown by way of illustration. It is to be understood that other embodiments may be used as structural and other changes may be made without departing from the scope of the present invention.

Generally, one embodiment of the present invention provides for an apparatus to help players, or users of the training apparatus, understand and improve their swing habits and also reduce problems in the golf tee shot, such as a slice ball, which is an especially common problem among beginner and intermediate players, or any other types of swings, such as a chip or a pitch. The apparatus also assists players in understanding the concepts of swing path, angle of attack, and the lowest point of the club head during a swing, and also assists players in developing a rhythm of swing. Embodiments of present invention help teach a player where the lowest point of the club head should be in order to perform a drive shot with maximum power and accuracy in trajectory, and a significant difference in performance can be achieved. By providing substantially immediate feedback on the player's golf swing, they can realize how they are hitting the golf ball and therefore develop an improved and efficient golf swing, including understanding how well they are performing with respect to swing path, angle of attack, and swing tempo. The substantially immediate feedback after each swing helps keep players from practicing improperly and therefore can help keep players from implanting bad habits into their golf swing.

Figure 1:
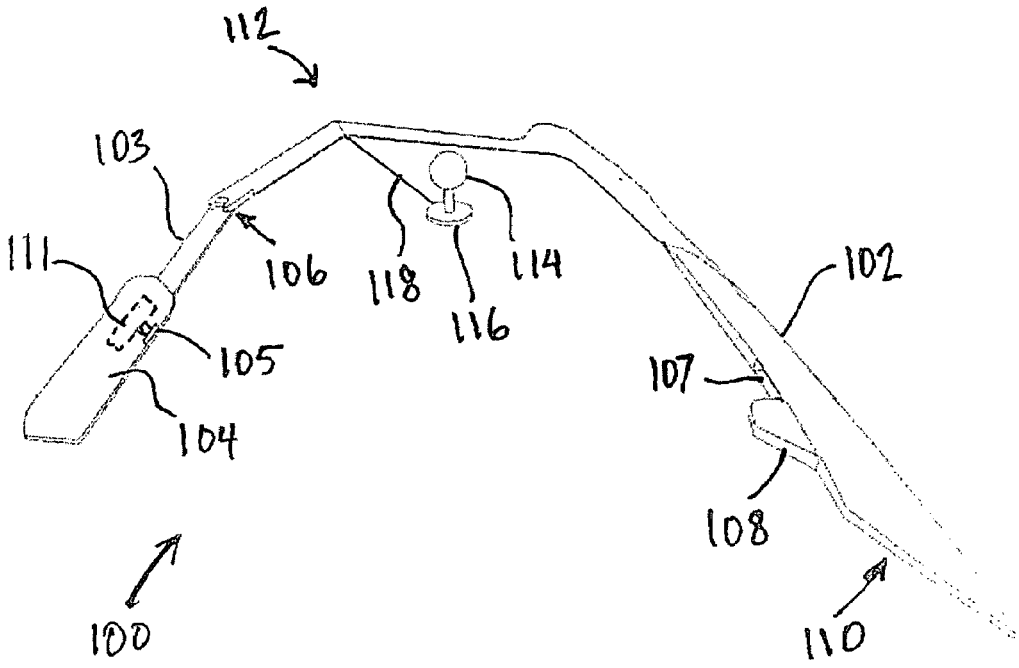
FIG. 1 is a perspective rear view of a first embodiment of a training apparatus, in accordance with an embodiment of the present invention.

FIG. 1 is a perspective rear view of a training apparatus, in accordance with an embodiment of the present invention. The training apparatus 100 generally includes a frame 102 and a sensor unit 104. The sensor unit 104 is coupled to the frame 102 at a slide coupling 106. However, any suitable coupling of the sensor unit 104 to the frame 102 may be used. In the illustration, an arm 103 extends from the sensor unit 104 to the coupling 106. However, any suitable configuration of any number of components may be used to arrange for suitable positioning of the sensor unit 104. In other embodiments, the sensor unit 104 need not be coupled to the frame 102. The sensor unit 104 holds a sensor 105 and a microcontroller unit 111 that is in operable communication with the sensor 105. The frame 102 as illustrated has a generally arcuate shape. The frame 102 includes a reflector 107 and a reflector guard 108. The reflector end 110 of the frame 102 serves as a swing guide by outlining one effective swing path for a golf club to travel on a backswing. The frame includes a direction edge, referred to generally by reference number 112. The direction edge is a generally arrow-shaped portion of the frame 102 that indicates the direction of travel for a struck golf ball. The direction edge also assists the user to properly line up the training apparatus when, for example, using the training apparatus at a driving range.

In one embodiment, the sensor unit 104 is movably coupled to the frame 102 by the coupling 106 to provide for adjustment in the position or direction of the sensor 105 and also to reduce the size of the training apparatus 100 for transportation and storage. However, the sensor unit 104 may integrally formed with the frame 102 or coupled to the frame 102 in any suitable way.

Figure 2:
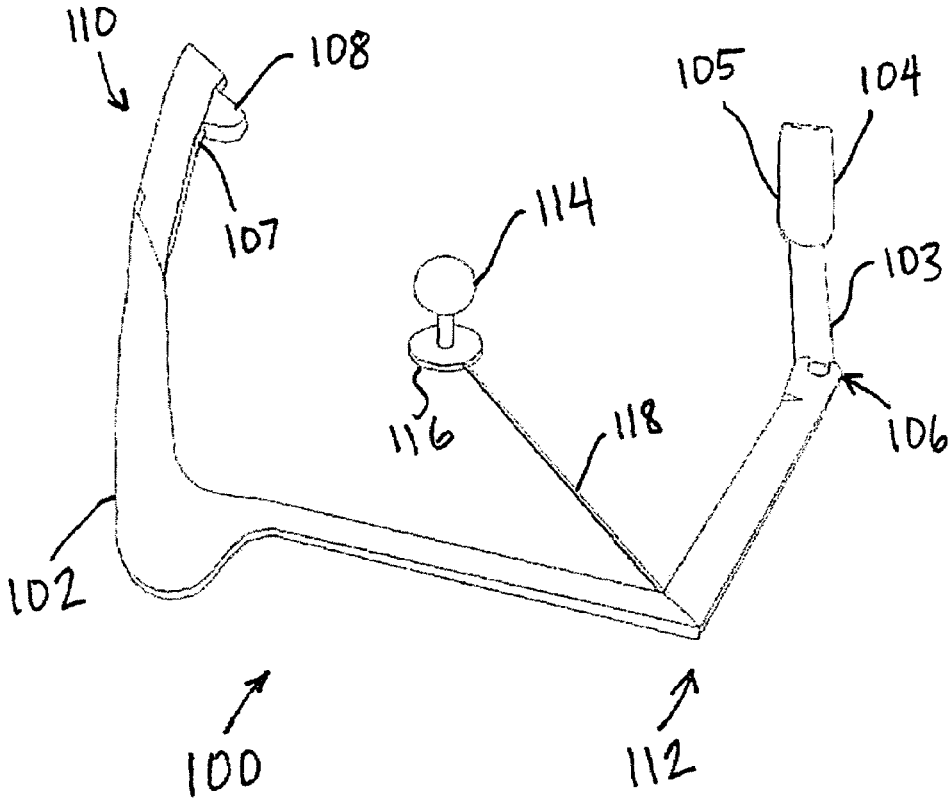
FIG. 2 is a perspective front view of the first embodiment of a training apparatus, in accordance with an embodiment of the present invention.

Referring to FIG. 2, a golf ball 114 is located on a ball tee 116 for illustrative purposes. In one embodiment, the ball tee 116 may be attachable to the frame 102, such as at the direction edge 112 of the frame, or a cord 118 may be included to assist in properly positioning the golf ball within the training apparatus 100. The position of the ball tee 116 may also be indicated by two or more reference markings on the frame to indicate one or more positions for the ball tee, such that aligning the ball tee with the markings assists the user in positioning the ball within the training apparatus. Any other suitable methods or devices may be used to locate the ball in the desired hitting position.

The frame 102 is made from any suitable material. In one embodiment, the frame 102 is made from polymer materials and is generally laterally rigid such that the frame 102 maintains its general shape. In another embodiment, the parts of the frame are made from substantially rigid, impact resistant materials that can sustain contact with the golf ball or golf club during use. However, in other embodiments, such materials may allow for the frame 102 to be bent or rolled for easy storage and shipping. While the frame 102 shown in the illustrations is a single, contiguous piece of material, the frame 102 may also be comprised of multiple pieces that may be connected and disconnected for easy storage and transportation. The sensor unit 104 is illustrated as having a housing for containing the microcontroller unit 111 and the sensor 105. The senor unit 104, in one embodiment, may be removably coupled by the arm 103 to the frame 102 at the coupling 106. In one embodiment, the arm 103 has a protrusion that couples with a slot in the end of the frame 102. The protrusion may have two generally parallel, flattened edges such that the protrusion may slide within the slot but generally not be rotated easily. Therefore, the longitudinally position of the sensor 105 may be adjusted without rotating the sensor unit 104, thereby pivoting the sensor unit 104 about the coupling 106.

FIG. 2 is a perspective front view of the training apparatus, in accordance with an embodiment of the present invention. The components shown and described with reference to FIG. 1 are similarly illustrated in FIG. 2, which is a perspective view of the training apparatus 100 from a view reverse from that that shown in FIG. 1. Similar components are identified with the similar reference numbers in FIG. 2 and throughout the description.

Figure 3:
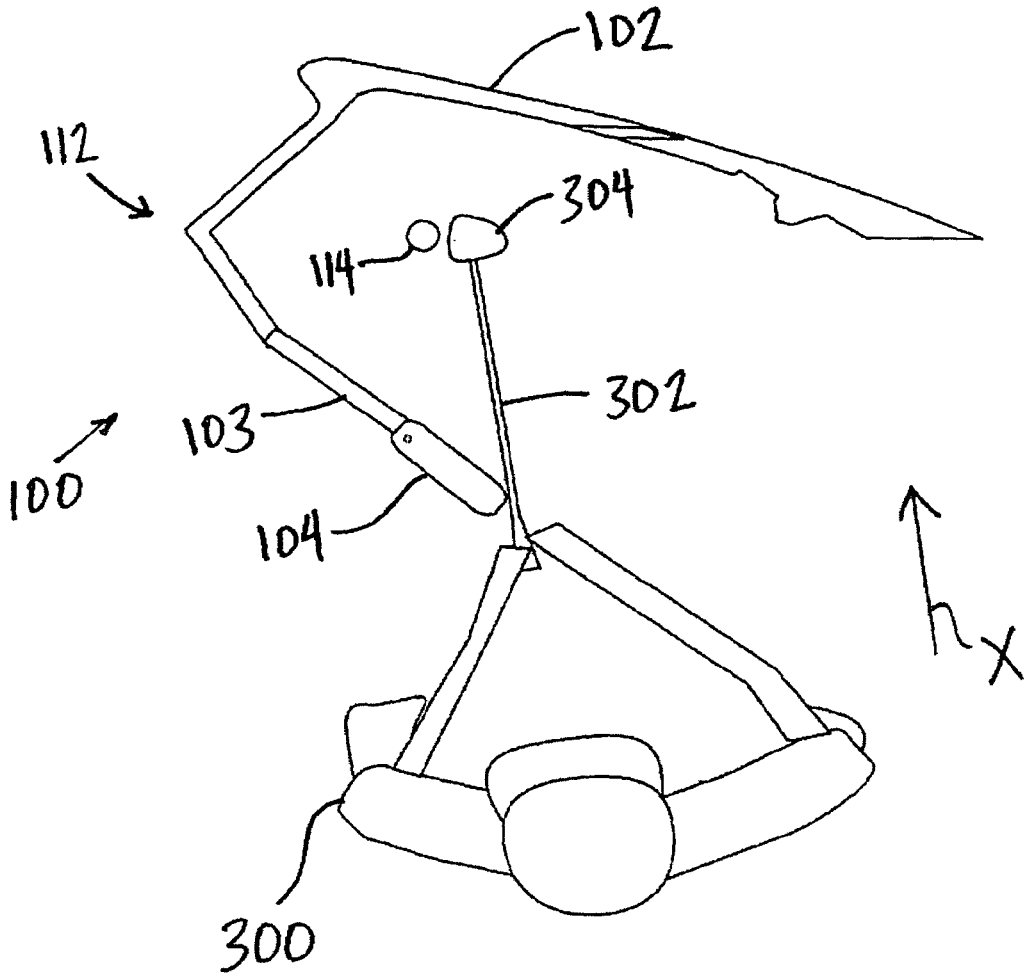
FIG. 3 is a top-view illustration of the first embodiment of a training apparatus, showing the position of a user of the training apparatus, in accordance with an embodiment of the present invention.

FIG. 3 is a top-view illustration of the training apparatus, showing a user 300 of the training apparatus, in accordance with an embodiment of the present invention. The user 300 stands in the position as generally illustrated, facing the direction indicated by arrow X. Also shown is the general position of a golf club 302 being held by the user 300, and the position of a club head 304 of the golf club 302 located behind the golf ball 114. As can be seen in the illustrations, as the user 300 begins a golf swing, in a backswing, and as the user 300 turns his body, he takes the golf club 302 to the user's 300 right, taking the club head 304 through the area between the sensor unit 104 and the reflector 107. More specifically, the club head 304 may pass through the light beam that is directed out from the sensor 105 to the reflector 107. During a downswing, the club head 304 may again pass through the light beam that is directed out from the sensor 105 to the reflector 107. In one embodiment, for example, if the player makes an improper body rotation and moves only the club head, the club head 304 may not pass through the sensor beam, the sensor 105 will not be triggered, and the user will know that the backswing was not proper.

The training apparatus 100, including the sensor 105 and the light beam, are configured such that optimal or proper golf swings will cause the club head 304 to pass through the light beam. If the club head 304 does not pass through the light beam, the light beam will not be broken and the sensor 105 will not receive any input, and therefore, no visual or audio signals will be given from the training apparatus. Therefore, from this absence of signals, the user 300 receives feedback that the swing was outside of the sensor area and therefore not a proper or optimal swing.

Figure 4:
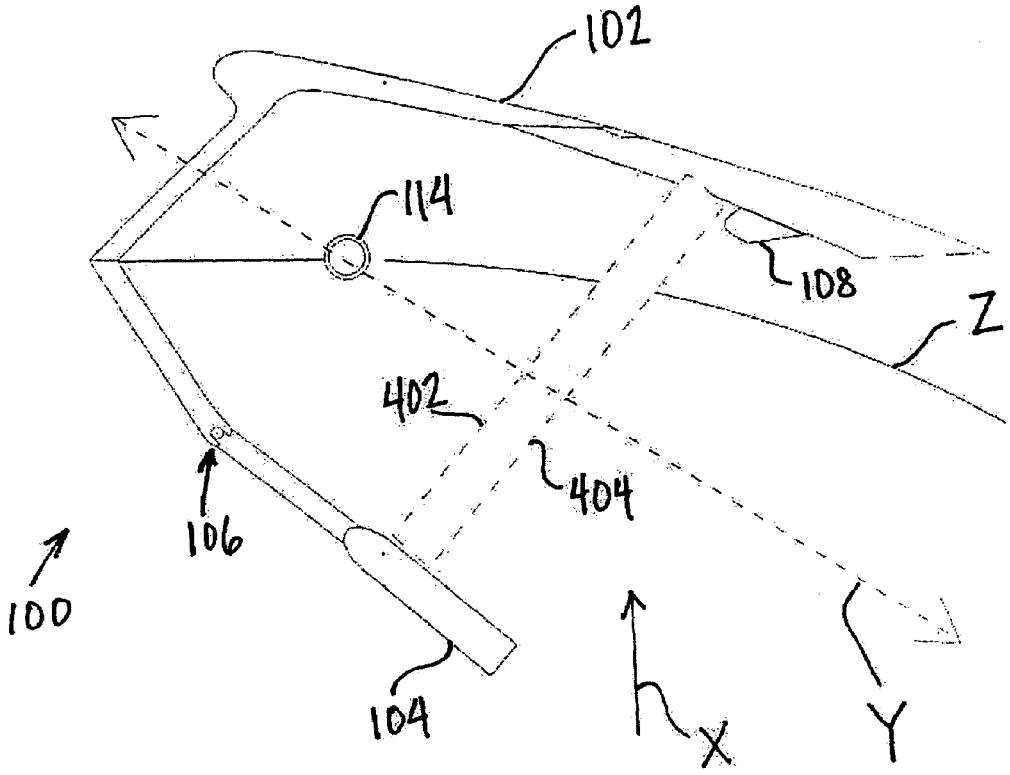
FIG. 4 is top-view illustration of the first embodiment of a training apparatus, in accordance with an embodiment of the present invention.

FIG. 4 is top-view illustration of the training apparatus, in accordance with an embodiment of the present invention. The components shown and described with reference to FIG. 1 are similarly illustrated in FIG. 4. Arrow Z generally shows the travel path of the club head 304 on a downswing in a direction toward the golf ball 114. Arrow X shows the general direction that the user (300, shown in FIG. 3) faces when using the training apparatus 100. Dashed reference lines 402 and 404 generally indicate the area of in which the light beam can extend between the sensor 105 and the reflector. The light beam extends from the sensor 105 in a generally horizontal direction. The user may vary in height and the position of the sensor 105 to change the vertical position of the light beam. By adjusting the position of the light beam, the user can adjust the point where they want the lowest point of club head to be.

The position of the sensor 105 may also be adjusted according to the height of the user, or the skill level of the user, so that users of different heights and skill levels can use the training apparatus. For example, taller people generally may reach a lowest point from the ball at a shorter distance away from the ball where shorter people generally will reach a lowest point a slightly further away from the ball. Therefore, the sensor may be moved back and forward, in direction perpendicular to the sensor light beam. In the illustrated embodiment, the training apparatus allows for approximately six (6) centimeters (cm) of adjustment for people of different height, however a greater range of adjustment may also be used. Also, such adjustment can allow people to adjust the sensor position according to the suitable or preferred location for lowest point during the golf swing.

The area illustrated by reference lines 402 and 404 is one example area for the light beam of the sensor. The position of the sensor and the location of the light beam from the sensor may be varied as necessary for the particular configuration of the training apparatus in accordance with the described embodiments of the present invention.

Figure 5:
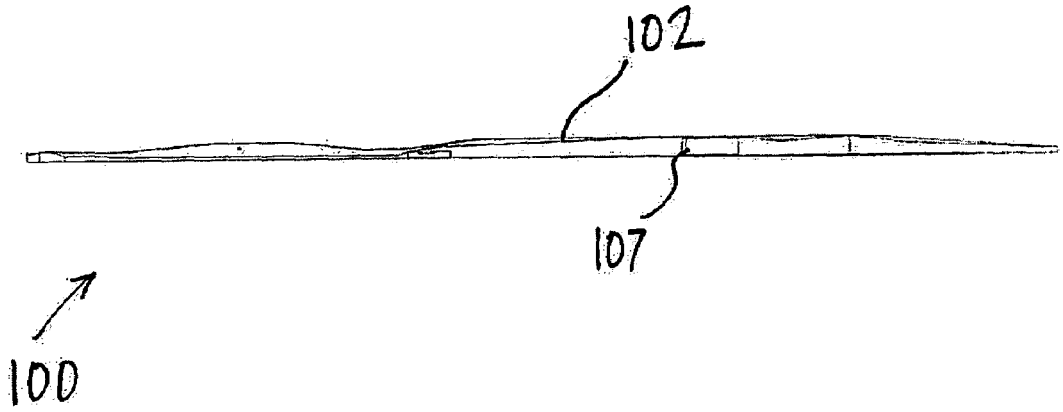
FIG. 5 is a sectional side view of the first embodiment of a training apparatus, taken about axis Y, showing a frame of the training apparatus, in accordance with an embodiment of the present invention.

FIG. 5 is a sectional side view of the training apparatus 100, showing the frame, taken about axis X, in accordance with an embodiment of the present invention. The height of the frame 102 and the reflector 107 can be seen from this sectional side view.

Figure 6:
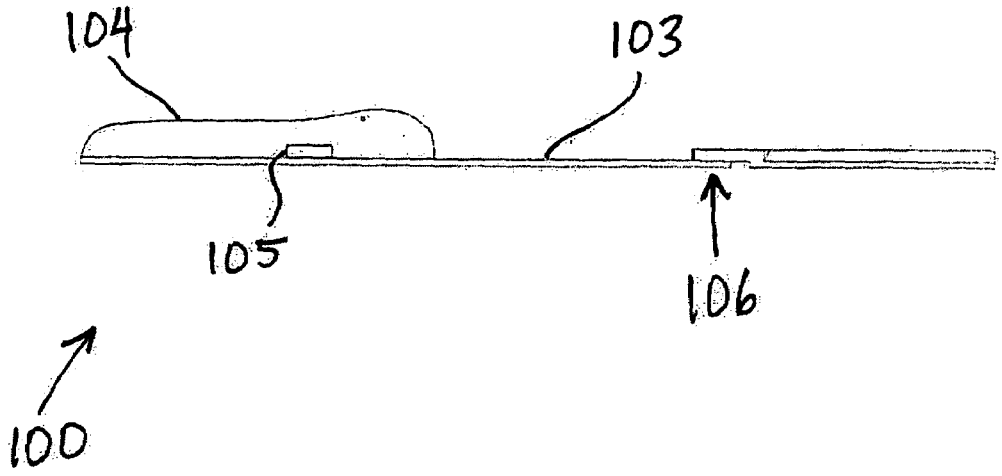
FIG. 6 is a sectional side view of the first embodiment of a training apparatus, taken about axis Y from an angle opposite from that shown in FIG. 6, showing a sensor unit of the training apparatus, in accordance with an embodiment of the present invention.

FIG. 6 is a sectional side view of the training apparatus 100, showing the sensor unit, taken about axis X from an angle opposite from that shown in FIG. 5, in accordance with an embodiment of the present invention. The sensor 105, the sensor unit 104, the arm 103, and the coupling 106 may be seen from this sectional side view.

Figure 7:
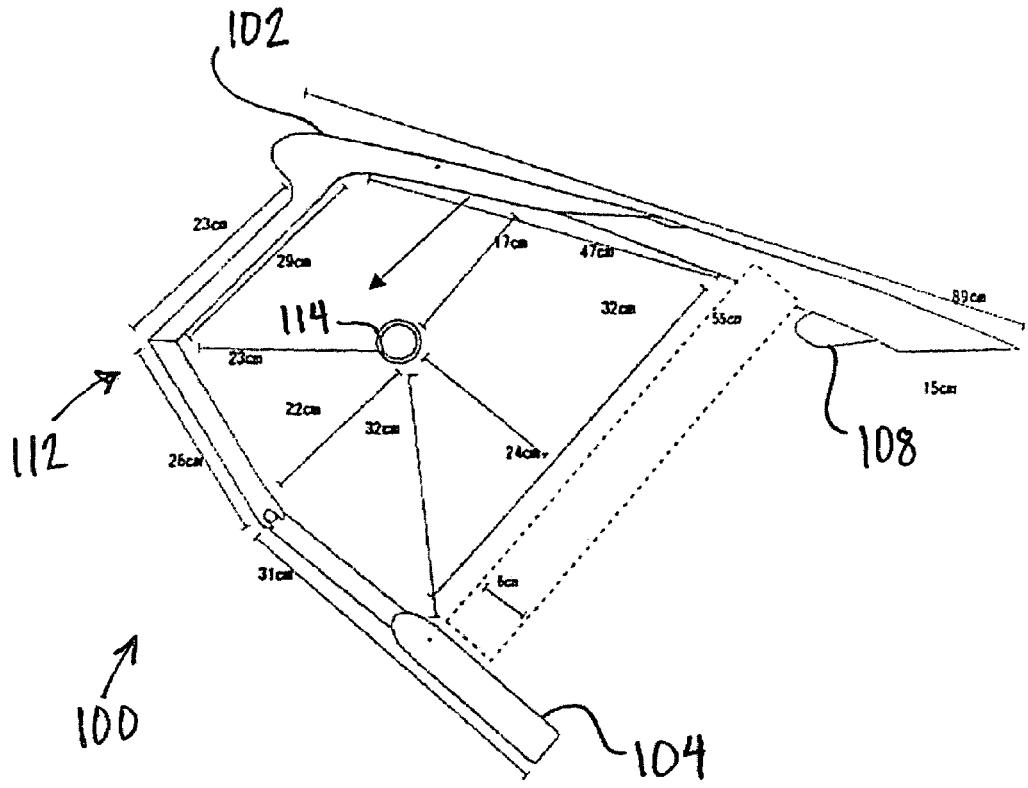
FIG. 7 is top-view schematic drawing of the first embodiment of a training apparatus, in accordance with an embodiment of the present invention.

FIG. 7 is top-view schematic drawing of the training apparatus, in accordance with an embodiment of the present invention. The schematic drawing shows example size and dimensions of the components of the training apparatus 100, according to an embodiment of the present invention. Other sizes and other dimensions may be used without departing from the scope of the invention. These details are provided to illustrate one example of sizing and positioning for use with the training apparatus 100. Also, while certain components are shown as separately joined components, the training apparatus 100 may be designed in any suitable manner, having any number of components contiguously formed, or having any number of separate components joined using any suitable coupling methods.

In the example schematic drawing shown in FIG. 7, the light beam may span a distance of approximately 55 cm between the sensor 105 and the reflector 107. The distance of 55 cm is based on the average human height or on a distance that reduces the possibility of damage to the sensor box 104 due to contact by the golf club. However, this distance, and any other distances, may be varied as necessary. The width of the area within which the light beam may be positioned is approximately 6 cm. This room for movement is provided for players of different height to make a correct approach to the ball tee, or ball, from the lowest point of attack angle. The distance between the light beam area and golf tee may be between approximately 24 cm and 34 cm. The distance, in one embodiment, provides an effective light beam detection area for players of most sizes. A distance between approximately 32 cm to approximately 40 cm is illustrated between the golf tee and the reflector guard 108. This distance, in one embodiment, is provided to reduce the possibility of slice for many different kinds of players. A distance of approximately 23 cm between the ball tee and the frame 102 may be provided to reduce the possibility of damage to the training apparatus 100 due to contact by the golf club head or a struck golf ball. Also, the direction edge 112, which is located in the path of the struck golf ball, may have a reduced height or be made of a resilient material that is less susceptible to damage caused by contact by the golf club head or the struck golf ball. A distance of approximately 31 cm from the coupling 106 to the end of the sensor unit 104 is provided to protect the sensor and provide an effective distance and angle for the sensor and reflector that allows players to practice the desired angle of attack, for example, including but not limited to pull shots, draw shots, push shots, and slice shots. The length of the frame 102 of approximately 89 cm may assist in creating an image of a desired swing path.

In one embodiment, a mirror may be positioned on the frame 102 to reflect the visual indicator from the sensor unit to the user. The user, in this embodiment, may view the reflected visual indicator at a position with angle of between approximately 70 to 100 degrees of the sensor unit. Such an angle allows the player to concentrate on the ball while limiting their lateral body movement after impact with the ball, if their swing is correct. Using this angle, the reflected visual signal helps the user understand the proper hitting position and notice if they are moving their body too much during or after the swing.

Figure 8:
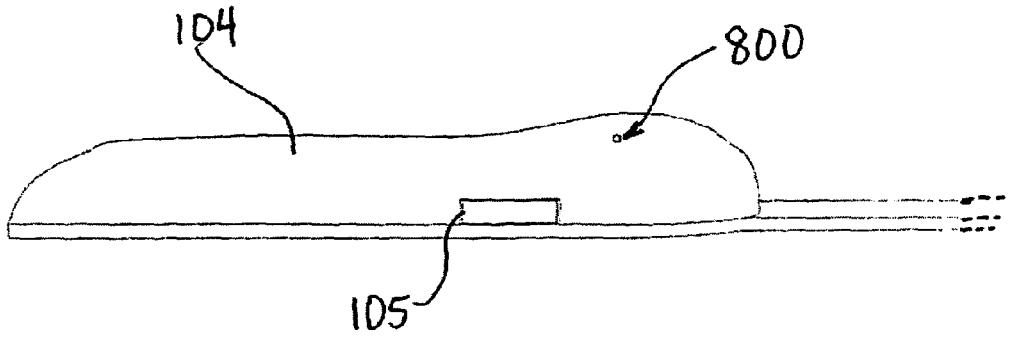
FIG. 8 is an enlarged elevation view of a sensor unit shown in FIG. 1, in accordance with an embodiment of the present invention.

FIG. 8 is an enlarged elevation view of a sensor unit, in accordance with an embodiment of the present invention. The sensor 105 is shown positioned generally horizontally to the surface, or base of the sensor unit contained generally within the sensor unit 104. In one embodiment, the height of the sensor 105, or the distance of the sensor 105 from the surface is adjustable. A visual indicator 800 is included on the sensor unit 104. The visual indicator 800 may be, for example, a light, such as a light emitting diode (LED), or other visual signal. One or more visual indicators may be included. For example, two or more LED or lights may be included to ensure that they are visible to the user. While the visual indicator 800 is shown on the sensor unit 104, the frame 102 may also includes a visual indicator in an easily visible location. Such visual indicators may be included, with appropriate wiring and power supply, in any location on the training apparatus. For example, one or more visual indicators may be located on the reflector end of the frame, in front of the user.

In one embodiment, the height of the sensor may be selectively adjustable, and therefore the height of the light beam emitting from the sensor is moved according to the height of the sensor. In one embodiment, the height of the sensor may be adjusted from approximately 8 millimeters to approximately 17 millimeters. For example, the height may be adjustable between the following ranges, including but not limited to: between approximately zero millimeters and 30 millimeters; between approximately 5 millimeters and 25 millimeters; and between approximately 6 millimeters and approximately 20 millimeters. However, the range of adjustment may be within any suitable range. In another embodiment, the height of the sensor may be fixed at a predetermined height.

The height of the sensor can be adjusted by adjusting the position of the sensor 105 within the sensor box 104. For example, the sensor may be on a sliding platform, or a vertically positioned, threaded rod which can be rotated to change the height of the sensor, or any other suitable height-adjustable mechanism. This, therefore, can change the height at which the light beam is directed away from the sensor box 104. Additionally or alternatively, the direction of the sensor may be angled upward or downward in order to adjust the effective height of the sensor beam at the general location where the golf club head should pass. In one embodiment, the sensor may have a default height of 17 mm from the ground, which has been shown to be a comfortable position for many people. However, when a user becomes more skilled, they can adjust the sensor 105 to a lower position for developing better accuracy of club head movement.

The height of the sensor is measured from the surface that the sensor unit is placed on. Similarly, the height of the sensor can also be measured relative to the sensor unit, the base of which being generally level with whatever surface the training apparatus will be located on. The height of the sensor 105 is adjusted according to the level at which the user wants the club head to trigger the sensor. For example, a lower height is selected if the user desires to practice having the club head pass at a point lower to the ground, and a higher height is selected if the user desires to practice having the club head pass at a point higher above the ground. In this way, the user can practice different positions of the club head in their golf swing.

In one embodiment, the sensor is designed to detect the movement of an object that is within approximately two meters (2M) from the sensor 105 and may detect fast moving objects such as, for example, objects moving at speeds up to two-hundred miles per hour (200 mph). The direction that the sensor 105 is aimed can be changed in order to receive a different response during use of the training apparatus 100. For example, the sensor may point to different locations on the reflector, varying the angle of the sensor beam between approximately 35 degree and approximately 85 degrees, relative to the ball flight direction. By changing the degree or direction of the sensor 105, player can choose to have response from the device when they are attempting to hit a ball with more draw, more pull, or more push. One example sensor that is suitable for use with embodiments of the present invention is a photoelectric switch, model E3Z, available from Omron Corporation. The example photoelectric switch emits a light beam, such as an infrared beam, a red beam, or a light beam, to detect motion. However, embodiments of the present invention are not limited to use with this example sensor and any other suitable sensor, using any suitable type of sensor beam, may be used. While the sensor 105 shown and described in illustrated embodiments uses a reflector to reflect the light beam back to the sensor, other types of sensors may be used. For example, two-part sensors where both parts of the sensor cooperate to detect motion may also be used.

In one embodiment, the training apparatus 102 includes an audio signal device, such as a buzzer or alarm or beeper, or other audible alerting device. The audio signal device may be located in any appropriate location, such as within the sensor unit 102 having holes to allow the sound of the audio signal device to project to the user. The audio signal can be combined with a visual indicator to give feedback to the user on their angle of attack. The audio signal device may also assist the user in developing a rhythm of swing. In one embodiment, during a swing, when the sensor 105 is triggered a first time on the user's backswing, the audio signal device will emit an first audible signal, such as, for example, a beep having a duration of approximately 0.2 second, or any other suitable period of time, such as between 0.4 second and 0.8 second. A second audible signal will sound a predetermined period of time after the sensor is triggered the first time, for example, approximately 0.6 seconds after the first audible signal, or any other suitable period of time. The second audible signal corresponds generally to the completion of the user's backswing. On the downswing, the club head will trigger the sensor 105 a second time, causing a third audible signal to be emitted, again for a duration of approximately 0.2 seconds, or any other suitable period of time. In one embodiment, the second beep is shorter than the first beep, such as a pattern of 0.2 second beep, followed by a 0.6 second interval, followed by a 0.1 second beep. Such a pattern of audible signals can give an indication to the user if the rhythm of swing is good or if the down swing is too fast or too slow. Other patterns of signals may be used. For example, after the sensor is triggered by the user's backswing, an audible signal may sound after each of two predetermined periods of time corresponding to (1) the end of the backswing and (2) the contact with the ball. The user can compare their action with the audible signals to determine whether their time is in agreement or out of rhythm with the predetermined, timed audible signals.

Any desired combination of visual and audio signals may be used either separately or together. For example, both visual and audio signals may be used to alert the user of the passage of the club head through the sensor, and both visual and audio signals may be used to provide rhythm and timing feedback to the user. In one embodiment, the user may select between two or more different modes of sensor and signal operation.

The microcontroller is coupled to each of the sensor, the visual indicator, and the audio signal. A suitable battery or other electrical source may be used to supply power to the training apparatus and its various components. The microcontroller may be any suitable microcontroller device configured to perform the operations of the herein described embodiments of the present invention. For example, the microcontroller may be an integrated circuit including a CPU and one or more timers for executing the necessary functions.

Figure 9:
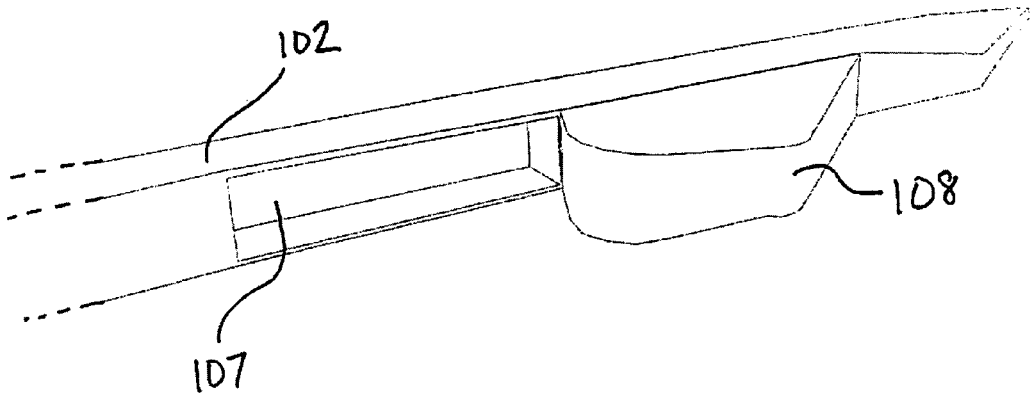
FIG. 9 is an enlarged elevation view of a sensor reflector shown in FIG. 1, in accordance with an embodiment of the present invention.

FIG. 9 is an enlarged elevation view of a sensor reflector, in accordance with an embodiment of the present invention. In one embodiment, the reflector 107 is a reflective strip that is attached to the appropriate location on the frame 102 with tape, glue or other adhesive. The reflector serves to reflect the light beam of the sensor back to the sensor for proper functioning. The reflector guard 108 protects the reflector from being struck by the user, which could result in damage or dislocation of the reflector 107. However, embodiments of the present invention are configured such that the reflector is located in a position that is generally out of the path of a typical golf swing when the user is positioned properly relative to the training apparatus.

Figure 10:
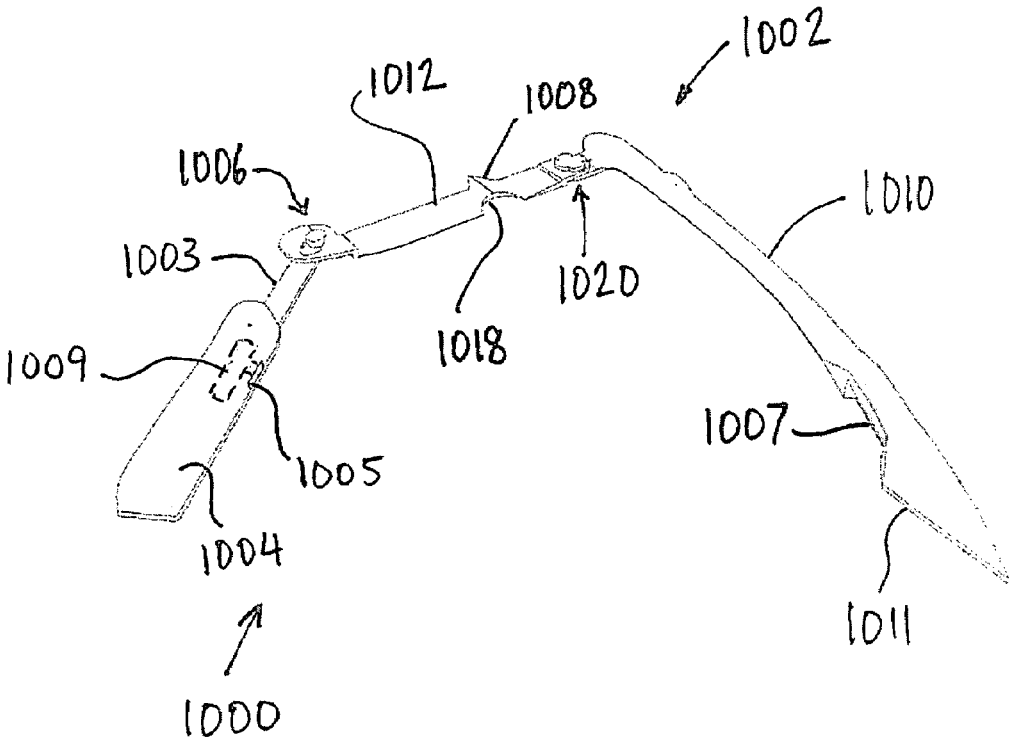
FIG. 10 is a perspective rear view of a second embodiment of a training apparatus, in accordance with an embodiment of the present invention.

FIG. 10 is a perspective rear view of a second embodiment of the training apparatus, in accordance with an embodiment of the present invention. It is to be understood that the general description of the first embodiment of the training apparatus similarly applies to the second embodiment of the training apparatus, unless otherwise stated. Therefore, the use, construction, material, and advantages as described above with reference to the first embodiment of the training apparatus may similarly apply to the description herein of the second embodiment of the training apparatus. Similarly, features and variations described with reference to the second embodiment may also apply, where suitable, to the above-described first embodiment of the training apparatus.

The training apparatus 1000 generally includes a frame 1002 and a sensor unit 1004. The sensor unit 1004 is coupled to the frame 102 at a coupling 1006. However, any suitable coupling of the sensor unit 1004 to the frame 1002 may be used. In the illustration, an arm 1003 extends from the sensor unit 1004 to the coupling 1006. However, any suitable configuration of any number of components may be used to arrange for suitable positioning of the sensor unit 1004. The sensor unit 1004 holds a sensor 1005 and a microcontroller unit 1009 that is in operable communication with the sensor 1005. The frame 1002 as illustrated has a generally arcuate shape and includes a direction edge 1012 coupled to a reflector edge 1010. The frame 1002 includes a reflector 1007. The reflector end 1011 of the reflector edge 1010 may have a flared out portion which serves as a reflector guard. The reflector edge 1010 of the frame 1002 also serves as a swing guide by outlining one effective swing path for a golf club to travel on a backswing. The direction edge 1012 couples the reflector edge 1010 to the sensor unit 1004. The direction edge 1012 is may include an arrow-shaped portion 1008 to indicate the direction of travel for a struck golf ball.

The direction edge may also include a semi-circular shaped recess 1018 for indicating the general position of a golf ball or golf tee. The golf ball, or golf tee, may be located proximate to the recess 1018 for hitting by the user of the training apparatus 1000. Any other suitable methods or devices may be used to locate the ball in the desired hitting position.

In one embodiment, the parts of the frame are made from substantially rigid, impact resistant materials that can sustain contact with the golf ball or golf club during use. However, in other embodiments, such materials may allow for the frame 1002 to be bent or rolled for easy storage and shipping. While the frame 1002 shown in the illustrations is formed from the direction edge 1012 and the reflector edge 1010, the frame 1002 may also be comprised of one, two, or more than two components that may be connected and disconnected for easy storage and transportation. The sensor unit 1004 is illustrated as having a housing for containing the microcontroller unit and the sensor 1005.

The senor unit 1004, in one embodiment, may be removably coupled by the arm 1003 to the direction edge 1012 at the coupling 1006 to reduce the size of the training apparatus 1000 for transportation and storage. However, the sensor unit 1004 may integrally formed with the frame 1002 or coupled to the direction edge 1012 in any suitable way. In one embodiment, the arm 1003 has a protrusion that slidably couples with a slot in the end of the direction edge 1012. The protrusion may have two generally parallel, flattened edges such that the protrusion may slide within the slot but generally not be rotated easily. Therefore, the longitudinal position of the sensor 1005 may be adjusted without rotating the sensor unit 1004, thereby pivoting the sensor unit 1004 about the coupling 1006. A second end of the direction edge 1012 is coupled to the reflector edge 1010 by a second coupling 1020. In one embodiment, the second coupling 1020 is a screw coupling that allows the user to easily attach and detach the direction edge 1012 to and from the reflector edge 1010. Also, the second coupling 1020 may be loosened to allow rotation of the direction edge 1012 relative to the reflector edge 1010. The second coupling 1020 is described in greater detail with reference to FIG. 12.

Figure 11:
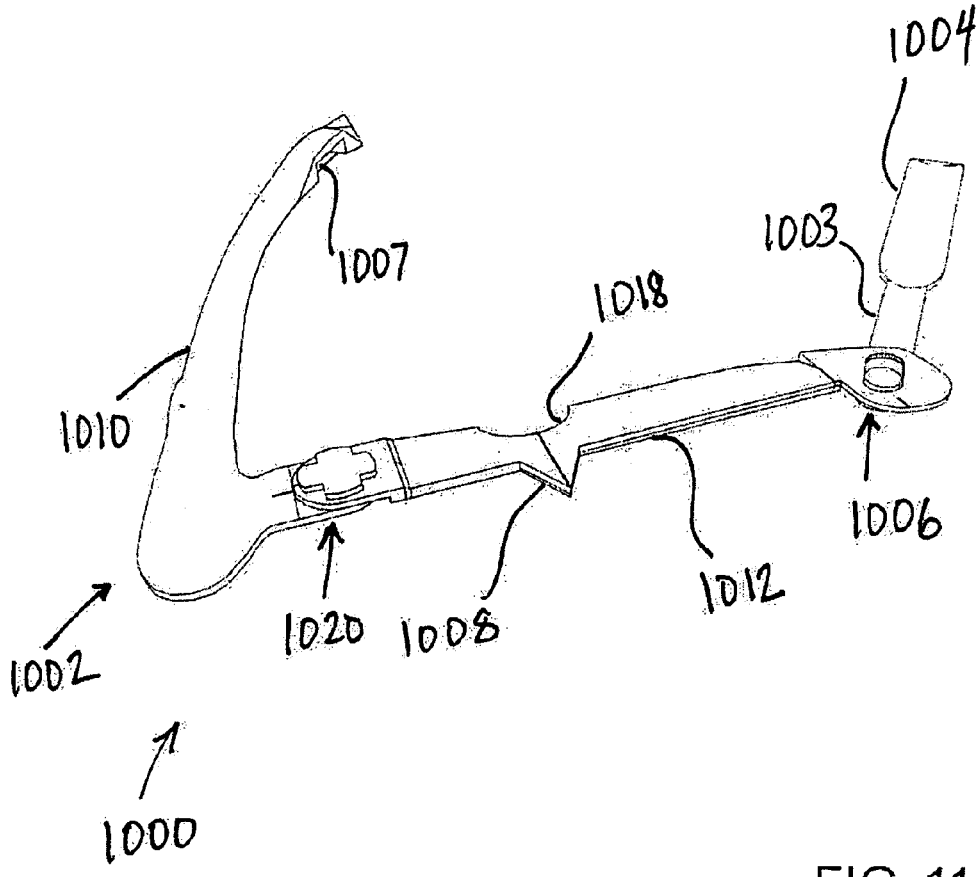
FIG. 11 is a perspective front view of the second embodiment of a training apparatus, in accordance with an embodiment of the present invention.

FIG. 11 is a perspective front view of the second embodiment of a training apparatus, in accordance with an embodiment of the present invention. The components shown and described with reference to FIG. 10 are similarly illustrated in FIG. 11, which is a perspective view of the training apparatus 1000 from a view reverse from that that shown in FIG. 10.

Figure 12:
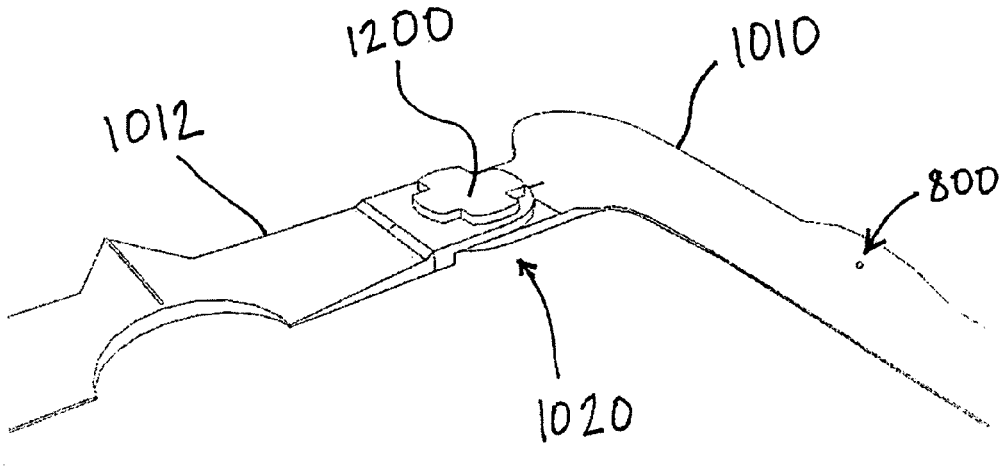
FIG. 12 is a close-up view of a direction edge coupling of the second embodiment of a training apparatus, shown in FIGS. 10 and 11, in accordance with an embodiment of the present invention.
Figure 15:
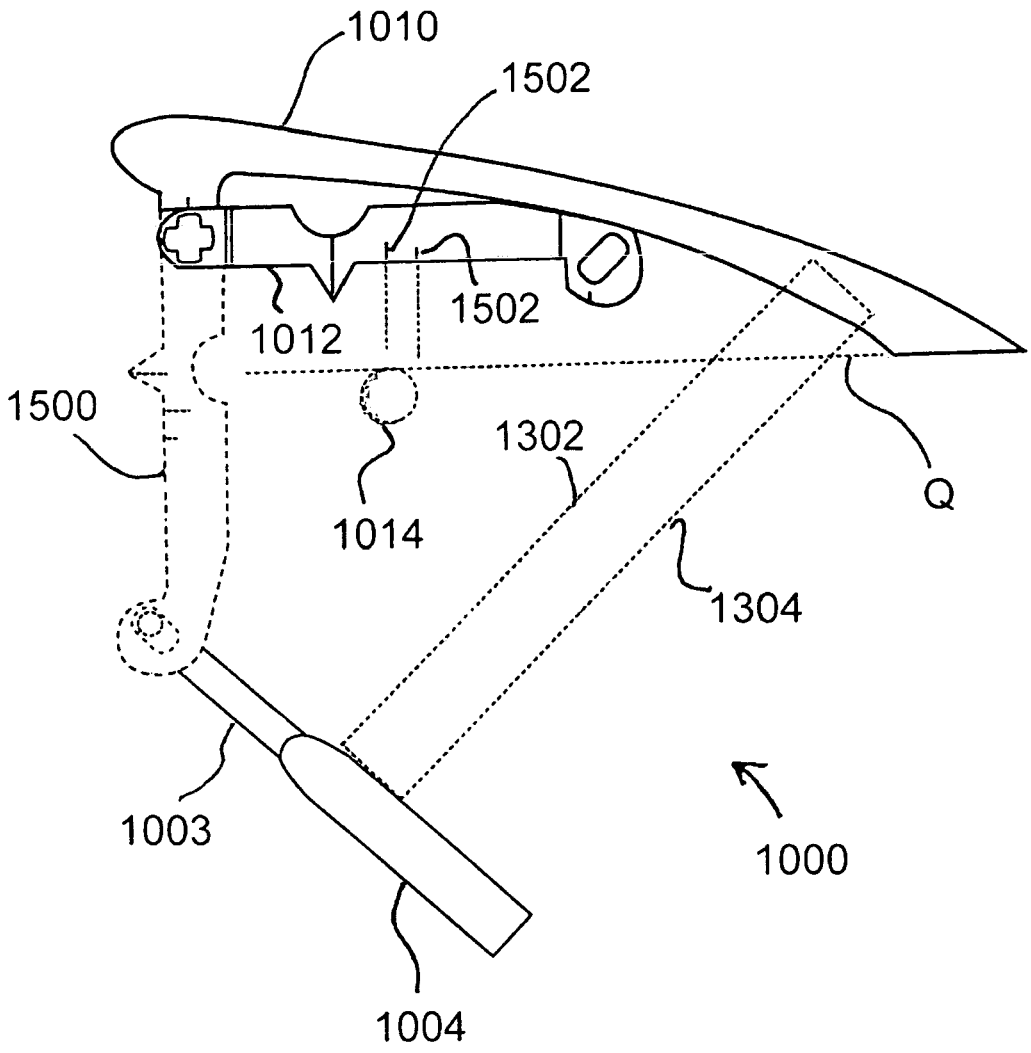
FIG. 15 is top-view illustration of the second embodiment of a training apparatus showing the direction edge in a second position, in accordance with an embodiment of the present invention.
Figure 16:
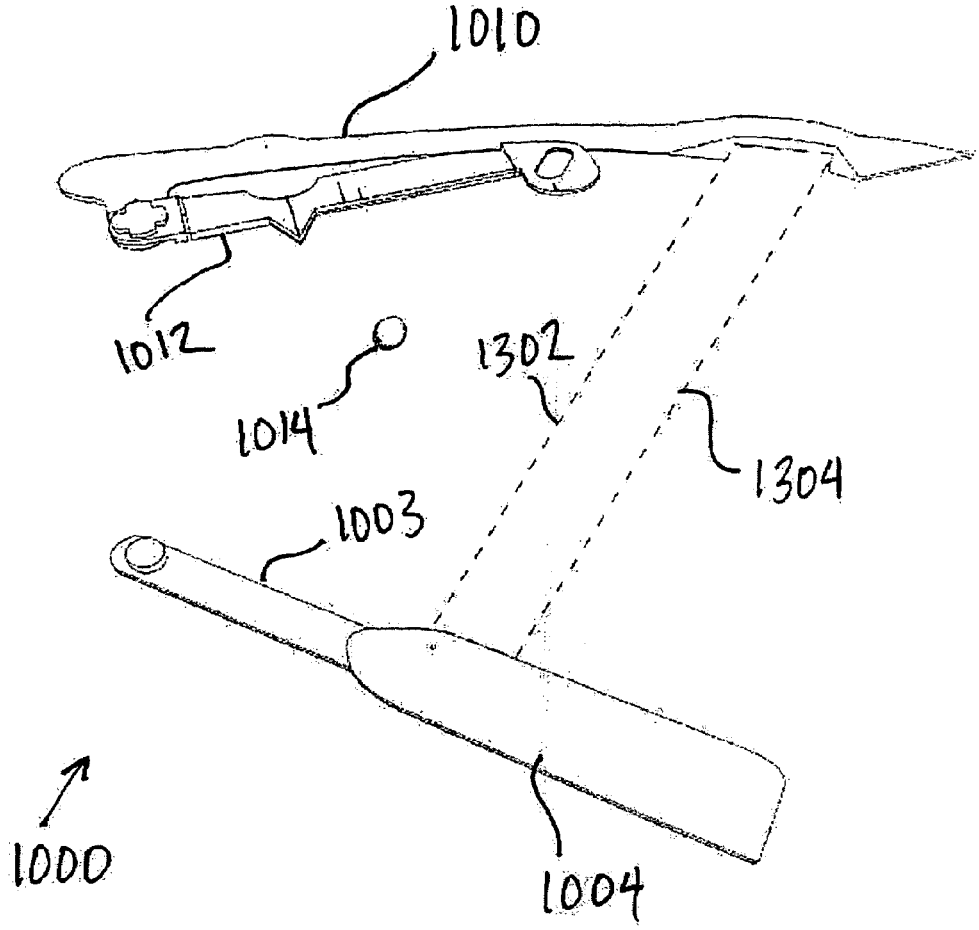
FIG. 16 is a perspective side view of the second embodiment of a training apparatus showing the direction edge in a second position, in accordance with an embodiment of the present invention.

FIG. 12 is a close-up view of a direction edge coupling of the second embodiment of a training apparatus, shown in FIGS. 10 and 11, in accordance with an embodiment of the present invention. The second coupling 1012 includes a coupling fastener 1200, which in the illustrated embodiment is a cross-shaped knob which may be easily manipulated by the hand of a user without requiring the use of tools or other equipment. In one embodiment, the coupling fastener may be rotated clockwise and counter-clockwise between a fastened position and an unfastened position, wherein in the unfastened position, the direction edge 1012 may be rotated and/or removed relative to the reflector edge 1010. In another embodiment, the knob may be part of a threaded coupling, wherein rotation of the knob tightens or loosens the coupling similar to a screw and bolt coupling. However, any other similar couplings may be used. In one embodiment, there may be markings on either or both of the reflector edge 1010 and the direction edge to show proper positioning of the direction edge 1012. Also, there may notches or protrusions in the direction edge 1012 and complementary recesses in the reflector edge 1010, or vice versa, that fit together when the direction edge 1012 is rotated to the proper location, in either of a first position and a second position. A visual indicator 800 may be included on the reflector edge or any other position on the frame. The direction edge 1012 is shown in FIGS. 10 through 14 being generally located in the first position. The direction edge is shown in FIGS. 15 and 16 as being generally located in the second position.

Figure 13:
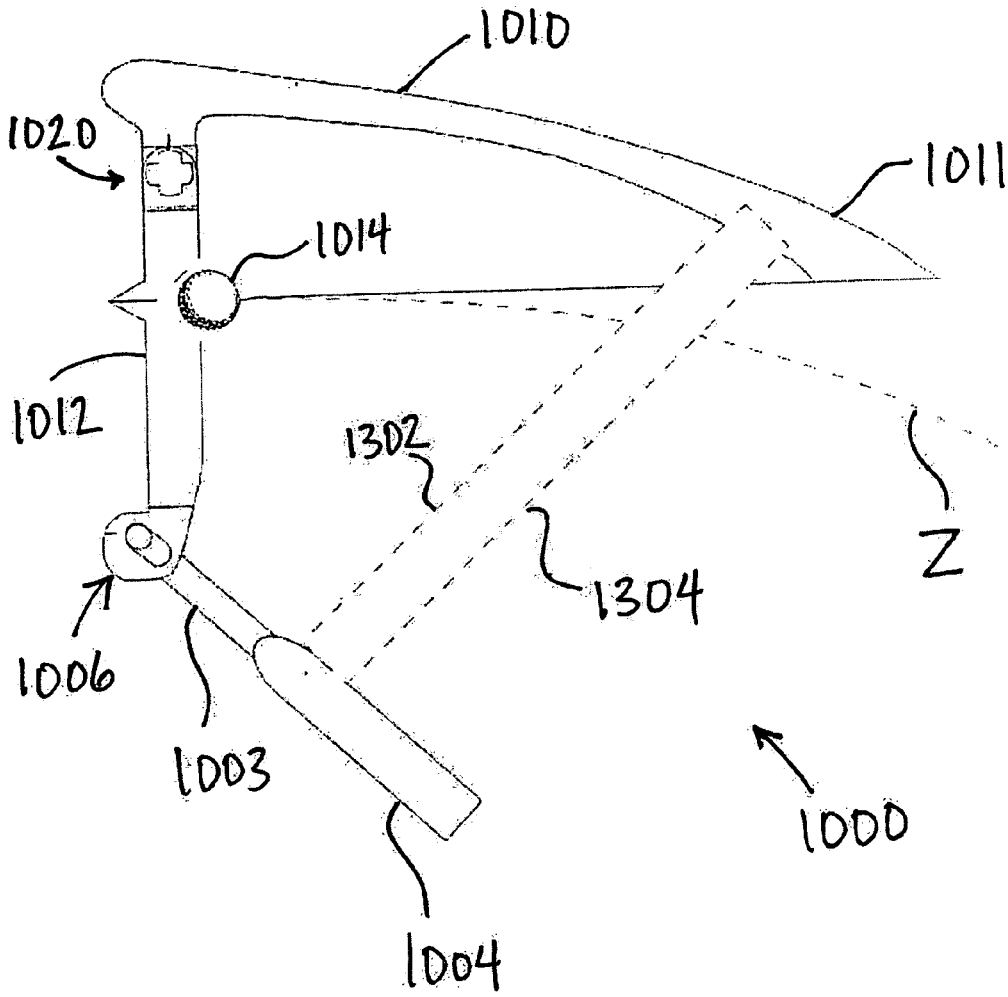
FIG. 13 is top-view illustration of the second embodiment of a training apparatus, in accordance with an embodiment of the present invention.

FIG. 13 is top-view illustration of the second embodiment of the training apparatus 1000, in accordance with an embodiment of the present invention. The components shown and described with reference to FIG. 10 are similarly illustrated in FIG. 13. Also shown are a golf ball 1014, which may be located proximate to the direction edge 1012, proximate to the recess 1018. The swing path of the golf club head is illustrated approximately by reference line Y. Dotted lines 1302, 1304 (also shown in FIGS. 14 through 16) indicate an example area within which the sensor beam is adjustable.

Figure 14:
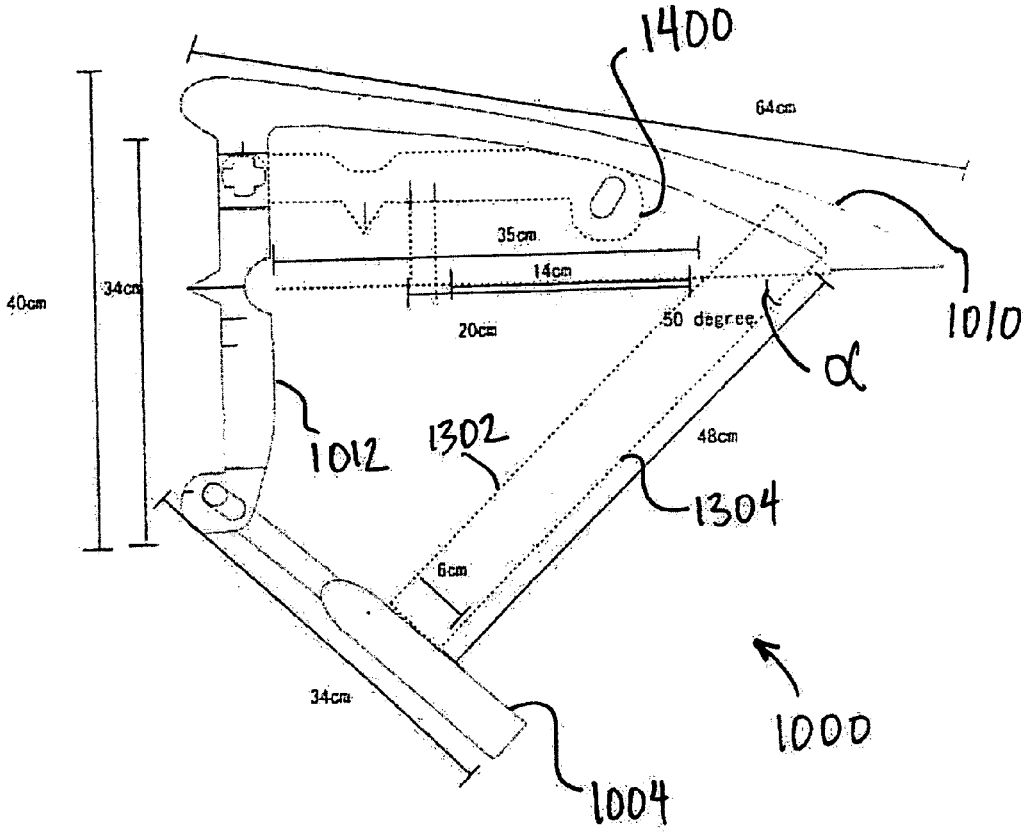
FIG. 14 is top-view schematic drawing of the second embodiment of a training apparatus, in accordance with an embodiment of the present invention.

FIG. 14 is top-view schematic drawing of the second embodiment of a training apparatus, in accordance with an embodiment of the present invention. The schematic drawing shows example size and dimensions of the components of the training apparatus 1000, according to an embodiment of the present invention. Other sizes and other dimensions may be used without departing from the scope of the invention. These details are provided to illustrate one example of sizing and positioning for use with the training apparatus 1000. Also, while certain components are shown as separately joined components, the training apparatus 1000 may be designed in any suitable manner, having any number of components contiguously formed, or having any number of separate components joined using any suitable coupling methods. It may also be seen that the angle $\alpha$, the angle between the sensor beam and the general direction of ball flight, is approximately 50 degrees. However, embodiments of the present invention are not limited to this angle and may include other suitable angles. In one embodiment, the angle $\alpha$ may be less than or equal to approximately 90 degrees. In another embodiment, the angle $\alpha$ may be greater than or equal to approximately 90 degrees. In another embodiment, the angle $\alpha$ may be within a range of approximately 25 degrees and approximately 75 degrees.

By rotating or loosening the second coupling 1020, the direction edge 1012 may be rotated approximately 90degrees toward the reflector edge 1010 from the first position to a second position. In FIG. 14, the second position 1400 of the direction edge 1012 is illustrated in dashed lines to indicate the alternate positioning of the direction edge 1012. In the second position, embodiments of the training apparatus may be used for chipping and pitching practice.

When golfers strike a ball from the ground and not from a tee, a different angle of attack is needed into the ball. For example, when a ball sits on the ground, a descending angle of attack from golf club head to the ball should be used to send the ball into the air. This action will make the ball run up the face of the club and impart backspin on the golf ball. Chipping and pitching the golf ball to a green requires the descending angle of attack to the golf ball in order to create solid impact from the golf club sweet spot (i.e. the centre of the clubface) and produce backspin and elevation to the golf ball, which will give control of the ball on landing for short game shots.

When making a chip or a pitch shot, the takeaway should be steeper than the takeaway of a longer golf club, such as a wood. This steeper takeaway is done by the wrists either hinging the club during the takeaway or making a forward press from the hands before the takeaway which also hinges the wrist. A player may also put more weight to the left leg, of a right-handed golfer, to aid the steeper takeaway. All these factors assist the golfer to make the proper angle into the backswing. Then the suitable descending angle can be achieved for chipping and pitching the golf ball. For instance, if a golfer has no hinge or set in the wrists in the takeaway and moves too much weight into the right leg in the backswing, a descending angle of attack into the ball needed for chipping and pitching would not be easily made.

Accordingly, embodiments of the present invention may be used for chipping and pitching practice. However, when practicing chipping and pitching, the location of the golf ball and user relative to the sensor are altered such that the golf club head does not trigger the sensor upon the execution of a proper chip or pitch. If the golf club head does trigger the sensor, the likely result will be a shot that has been duffed (club hitting the ground behind the ball) or thinned (club hitting the ball with the front edge of the club). Both of these shots should be avoided for a proper pitch or chip.

FIG. 15 is top-view illustration of the second embodiment of a training apparatus showing the direction edge in a second position, in accordance with an embodiment of the present invention. Components shown and described with reference to FIG. 10, if visible from the top-view, are similarly illustrated in FIG. 15. Also shown is the position of a golf ball 1014 when used with the direction edge 1012 in the second position. The direction edge 1012 may include markings which shown one or more positions for placing the golf ball for practice. The markings on the direction edge 1012 assist the user in placing the golf ball 1014 when hitting a correct chip or pitch. The golf ball 1014 may also be lined up with axis Q, which is the line formed between the end of the reflector edge 1010 and the arrow-shaped portion 1008 of the direction edge 1012. In FIG. 15, the first position 1500 of the direction edge 1012 is illustrated in dashed lines to indicate the alternate positioning of the direction edge 1012.

In one embodiment, a correct chip or pitch executed while using training apparatus will not trigger the sensor on either the takeaway or the downswing. Using the sensor in this way can give feedback on the use of irons or woods shots made from the ground. For example, a punch shot into the wind requires a more descending approach. Also, also "bad lie" shot, such as a ball in a divot, in the rough or even a fairway bunker, can require this type of approach to the ball. If a mistake is made on the takeaway, the user will receive feedback and will know to start the swing again and not complete the swing. Or if the mistake is made in the downswing, again nearly immediate feedback is given by the training apparatus. Also, the golfer can determine whether an error is a result of a backswing mistake or a downswing mistake. In this and other embodiments, practice swings may be made either indoor or outdoor, and either with or without striking an actual golf ball.

FIG. 16 is a perspective side view of the second embodiment of a training apparatus showing the direction edge in a second position, in accordance with an embodiment of the present invention. The components shown and described with reference to FIG. 10 are similarly illustrated in FIG. 16. The location of the golf ball 1014 is also shown when used with the direction edge 1012 in the second position.

While some of the illustrated embodiments show a golf ball and a golf tee, embodiments of the present invention may be used with or without a golf ball and golf tee and such use may be made in any suitable location. For example, the training apparatus 100 may be used at a driving range, where the training apparatus 100 may be positioned about the driving range tee in a proper position. Also, the training apparatus may be used without striking a ball, such as at home either indoors or outdoors, and feedback on the user's swing can similarly be provided. Accordingly, the training apparatus 100 will provide feedback on the swing without needing the user to strike an actual golf ball. Also, any suitable types of ball tees may be used. In one embodiment, a generally plastic ball tee with a height of approximately 3 cm and a ball tee with a height of approximately 4 cm may be used with embodiments of the present invention. However, ball tees of any suitable height and any suitable material may be used.

Those skilled in the art will appreciate that the above-described system may be implemented in a variety of configurations. For example, while certain components were described has having certain shapes and configurations, other shapes and configurations may be used without departing from the scope of the present invention. Also, while the various above-described components have been described as having certain criteria, such as being made from certain materials and whether a part is integrally formed with other parts, other components and variations in the shape and integration of the parts may also be made without departing from the scope of the present invention. Other shapes and sizes of the frame and sensor unit may also be used without departing from the scope of the invention. Also, while a separate sensor, microcontroller, visual indicators, and audio signals have been described, these and other components may be integrated or combined one or more separate components.

It should also be appreciated that the illustrated embodiments are illustrated for use by a right-handed user and that a similar method and apparatus may be constructed for use by a left-handed golfer. Also, an apparatus for use by both right-handed and left-handed golfers may also incorporate embodiments of the present invention.

The previous description of the exemplary embodiments is provided to enable any person skilled in the art to make and/or use the present invention. While the invention has been described with respect to particular illustrated embodiments, various modifications to these embodiments will readily be apparent to those skilled in the art, and the generic principles defined herein may be applied to other embodiments without departing from the spirit or scope of the invention. It is therefore desired that the present embodiments be considered in all respects as illustrative and not restrictive. Accordingly, the present invention is not intended to be limited to the embodiments described above but is to be accorded the widest scope consistent with the principles and novel features disclosed herein.

What is claimed is:

1. A golf swing training apparatus for developing a golf swing wherein a user of the golf swing training apparatus swings a golf club having a golf club head proximate to the golf swing training apparatus, the golf swing training apparatus comprising:

a sensor unit including a sensor outputting a sensor beam in a substantially horizontal direction relative to the ground and in a substantially diagonal direction relative to the swing, the sensor unit further including a microcontroller in operable communication with the sensor, the microcontroller configured to detect a break in the sensor beam, the sensor unit further including one or more visual indicators, wherein the one or more visual indicators are in operable communication with the microcontroller, and wherein the one or more visual indicators are activated in response to the break in the sensor beam; and a frame coupled to the sensor unit, the frame including a direction edge and a reflector edge, said reflector edge including a reflector configured to reflect the sensor beam, wherein the direction edge is selectively movable relative to the reflector edge between a first position and a second position, and in the first position a first end of the direction edge is removably coupled to the sensor unit and a second end of the direction edge is pivotably coupled to the reflector edge.

2. The golf swing training apparatus of claim 1, wherein the second end of the direction edge is further removably coupled to the reflector edge.

3. The golf swing training apparatus of claim 1, wherein the first end of the direction edge includes a slot and the sensor unit is slidably coupled to the first end of the direction edge, the sensor unit configured to slide in the longitudinal direction of the slot.

4. The golf swing training apparatus of claim 1, wherein when the direction edge is in the first position the training apparatus is configured for driving practice, and wherein when the direction edge is in the second position the training apparatus is configured for pitching practice.

5. The golf swing training apparatus of claim 1, wherein the direction edge includes one or more markings for indicating ball positioning when located in the second position.

6. The golf swing training apparatus of claim 1, wherein the height of the sensor in the sensor unit is selectively adjustable and the direction of the sensor beam is selectively adjustable.

7. The golf swing training apparatus of claim 1, wherein the microprocessor is configured to detect the break in the sensor beam when a golf club head passes through the sensor beam.

8. The golf swing training apparatus of claim 7, wherein the microcontroller is configured to detect the golf club head passing through the sensor beam on a backswing and the golf club head passing through the sensor beam on a downswing.

9. A golf swing training apparatus comprising:

a single sensor unit including a single sensor outputting a single sensor beam in a substantially horizontal direction, wherein the height of the sensor in the sensor unit is selectively adjustable between approximately 6 millimeters and approximately 20 millimeters above a base of the sensor unit, and the sensor beam is outputting in a direction selectively adjustable between a first position and a second position, the sensor unit further including a microcontroller in operable communication with the sensor, the microcontroller configured to detect a break in the sensor beam, the break in the sensor beam being generated in response to a golf club head passing through the sensor beam, the sensor unit further including one or more light emitting diodes and an audible alarm, wherein the one or more light emitting diodes and the audible alarm are in operable communication with the microcontroller, and wherein the one or more light emitting diodes and the audible alarm are activated in response to the break in the sensor beam; and a frame coupled to the sensor unit, the frame including a reflector configured to reflect the sensor beam and a reflector guard proximate to the reflector, the frame further having an arcuate shape outlining a golf swing path and a direction edge configured to indicate a ball travel direction.

* * * * *